US007846271B2

(12) United States Patent
Choi et al.

(10) Patent No.: US 7,846,271 B2
(45) Date of Patent: Dec. 7, 2010

(54) NON-ORIENTED ELECTRICAL STEEL SHEETS WITH EXCELLENT MAGNETIC PROPERTIES AND METHOD FOR MANUFACTURING THE SAME

(75) Inventors: Jae-Young Choi, Kyungsangbuk-do (KR); Byung-Keun Bae, Kyungsangbuk-do (KR); Jong-Tae Park, Kyungsangbuk-do (KR); Jae-Kwan Kim, Kyungsangbuk-do (KR); Chel-Min Park, Kyungsangbuk-do (KR)

(73) Assignee: Posco Co., Ltd., Kyungsangbuk-do (KR)

( * ) Notice: Subject to any disclaimer, the term of this patent is extended or adjusted under 35 U.S.C. 154(b) by 556 days.

(21) Appl. No.: 11/792,987

(22) PCT Filed: Dec. 20, 2005

(86) PCT No.: PCT/KR2005/004400

§ 371 (c)(1),
(2), (4) Date: Jun. 12, 2007

(87) PCT Pub. No.: WO2006/068399

PCT Pub. Date: Jun. 29, 2006

(65) Prior Publication Data

US 2008/0121314 A1 May 29, 2008

(30) Foreign Application Priority Data

Dec. 21, 2004 (KR) ..... 10-2004-0109644
Dec. 19, 2005 (KR) ..... 10-2005-0125220
Dec. 19, 2005 (KR) ..... 10-2005-0125221
Dec. 19, 2005 (KR) ..... 10-2005-0125222
Dec. 19, 2005 (KR) ..... 10-2005-0125223

(51) Int. Cl.
*H01F 1/147* (2006.01)

(52) U.S. Cl. ..... 148/111; 148/307

(58) Field of Classification Search ..... None
See application file for complete search history.

(56) References Cited

U.S. PATENT DOCUMENTS 6,139,650 A * 10/2000 Oda et al. ..... 148/306
2006/0124207 A1 * 6/2006 Takashima et al. ..... 148/546

FOREIGN PATENT DOCUMENTS

JP 0709762 28 4/1995

(Continued)

OTHER PUBLICATIONS

English-language abstract of Japanese Patent Publication No. JP 07-097628, published Apr. 11, 1995, esp@cenet database.
English-language abstract of Korean Patent Publication No. KR 10-2003-0052139, published Jun. 26, 2003, esp@cenet database.

*Primary Examiner*—John P Sheehan
(74) *Attorney, Agent, or Firm*—Cooper & Dunham LLP

(57) ABSTRACT

The present invention relates to technology for manufacturing electrical steel sheets having excellent magnetic properties through the control of a hot-rolled texture using the phase transformation of steel. More particularly, it relates to a non-oriented electrical steel sheet that has reduced iron loss and increased magnetic flux density by controlling alloy component elements and optimizing hot-rolling conditions, even though hot-rolled sheet annealing is not carried out, as well as a manufacturing method thereof. More specifically, the invention provides a non-oriented electrical steel sheet which has excellent magnetic properties while hot-rolled sheet annealing can be omitted, the steel sheet being comprised of 0.005 wt % or less of C, 1.0-3.0 w % of Si, 0.1-2.0 wt % of Mn, 0.1 wt % or less of P, 0.1-1.5 wt % of Al, and a remainder of Fe and other inevitable impurities, in which the relationship between the elements Mn and Al satisfies an equation of $-0.2<m(=Mn-Al)<1.0$, and a slab for the steel sheet, when reheated, has a two-phase region of austenite+ferrite at a temperature ranging from Arl to 1250° C.

6 Claims, 7 Drawing Sheets

FOREIGN PATENT DOCUMENTS

| | | |
|---|---|---|
| KR | 1020030052139 | 6/2003 |
| WO | WO 9308313 | 4/1993 |
| WO | WO 0168925 | 9/2001 |

* cited by examiner

【Fig. 1】
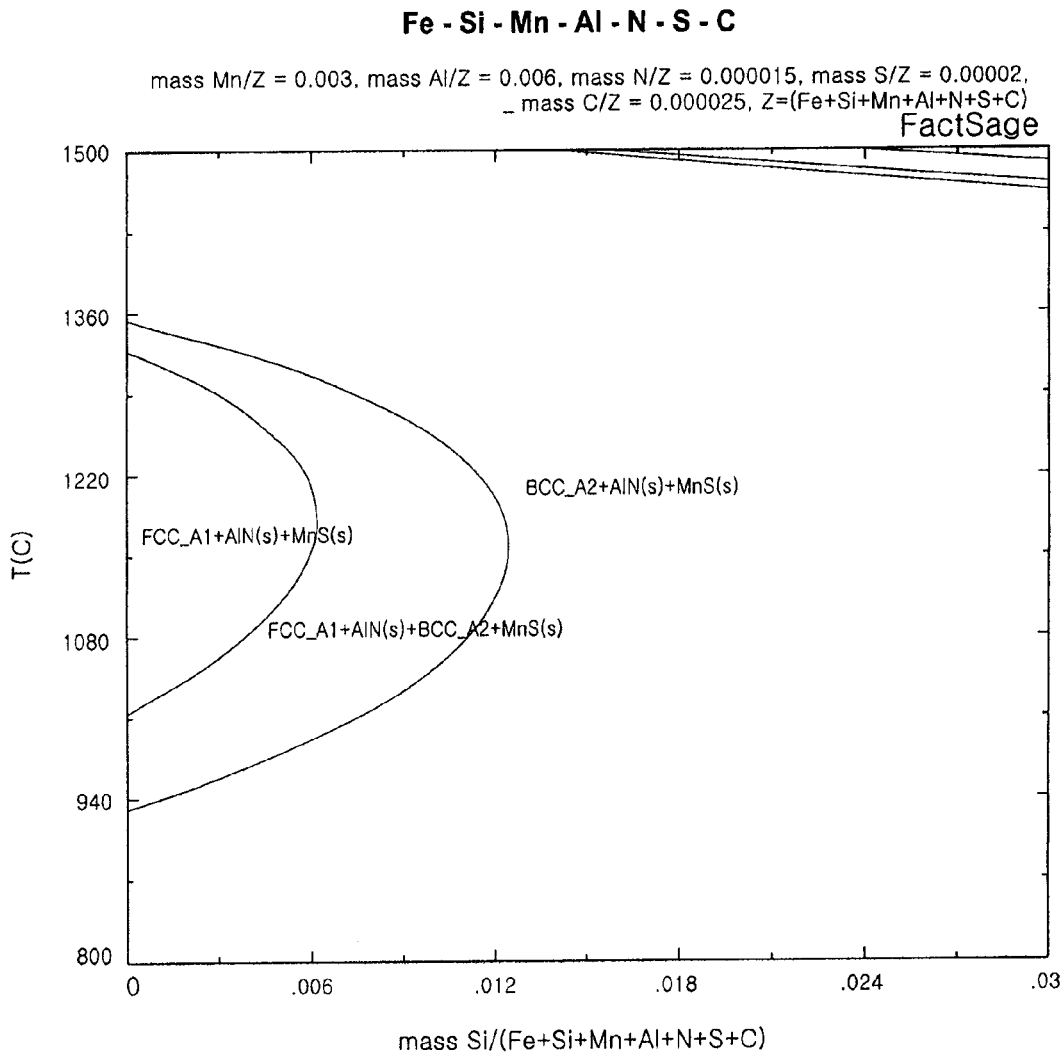

【Fig. 2】
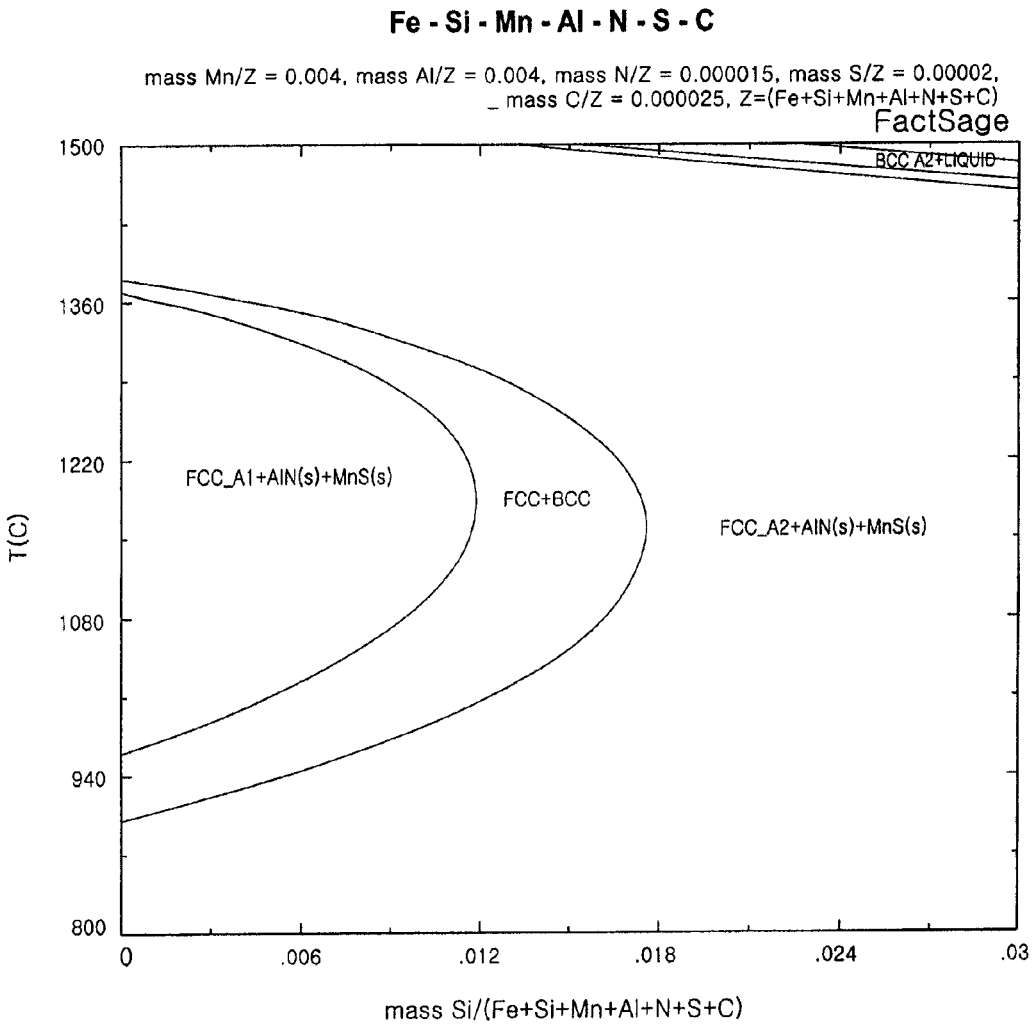

【Fig. 3】
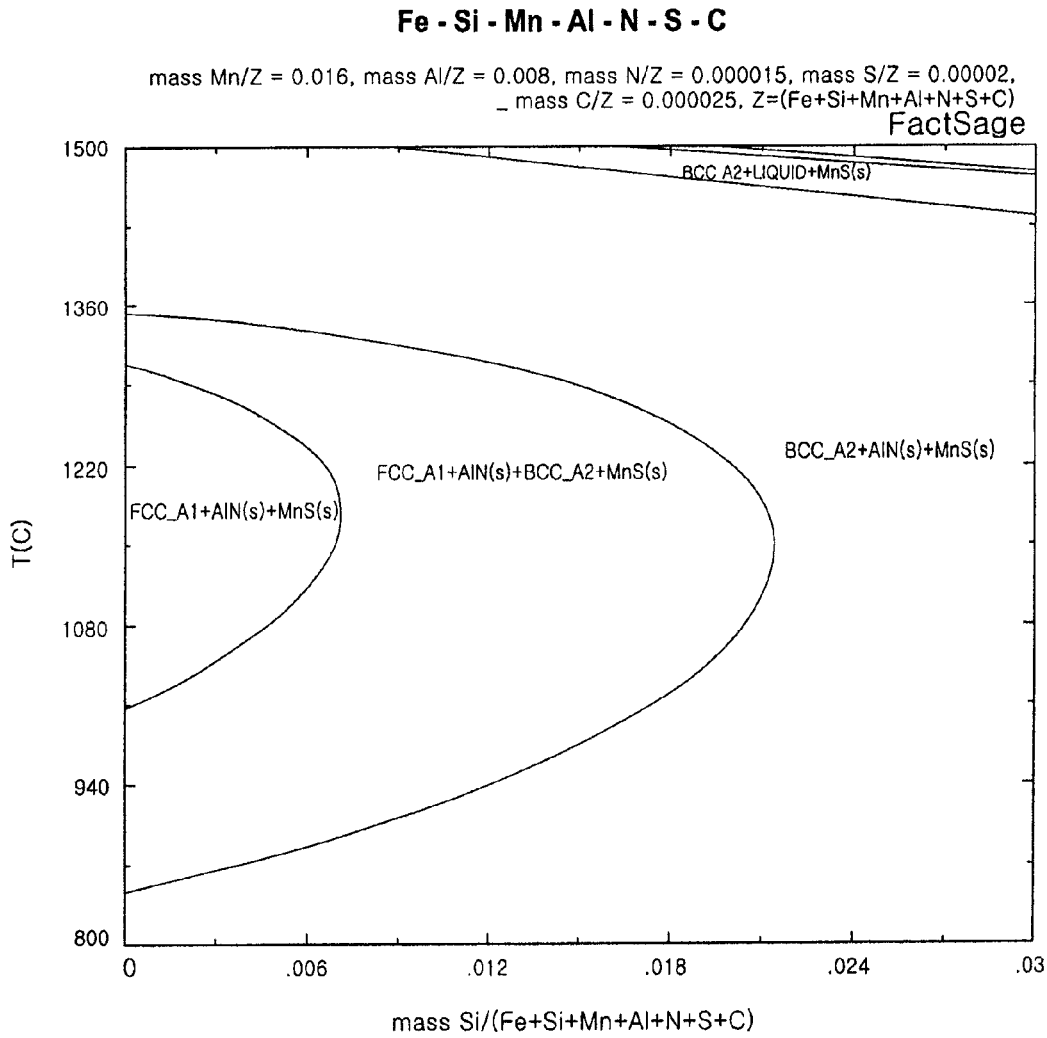

【Fig. 4】
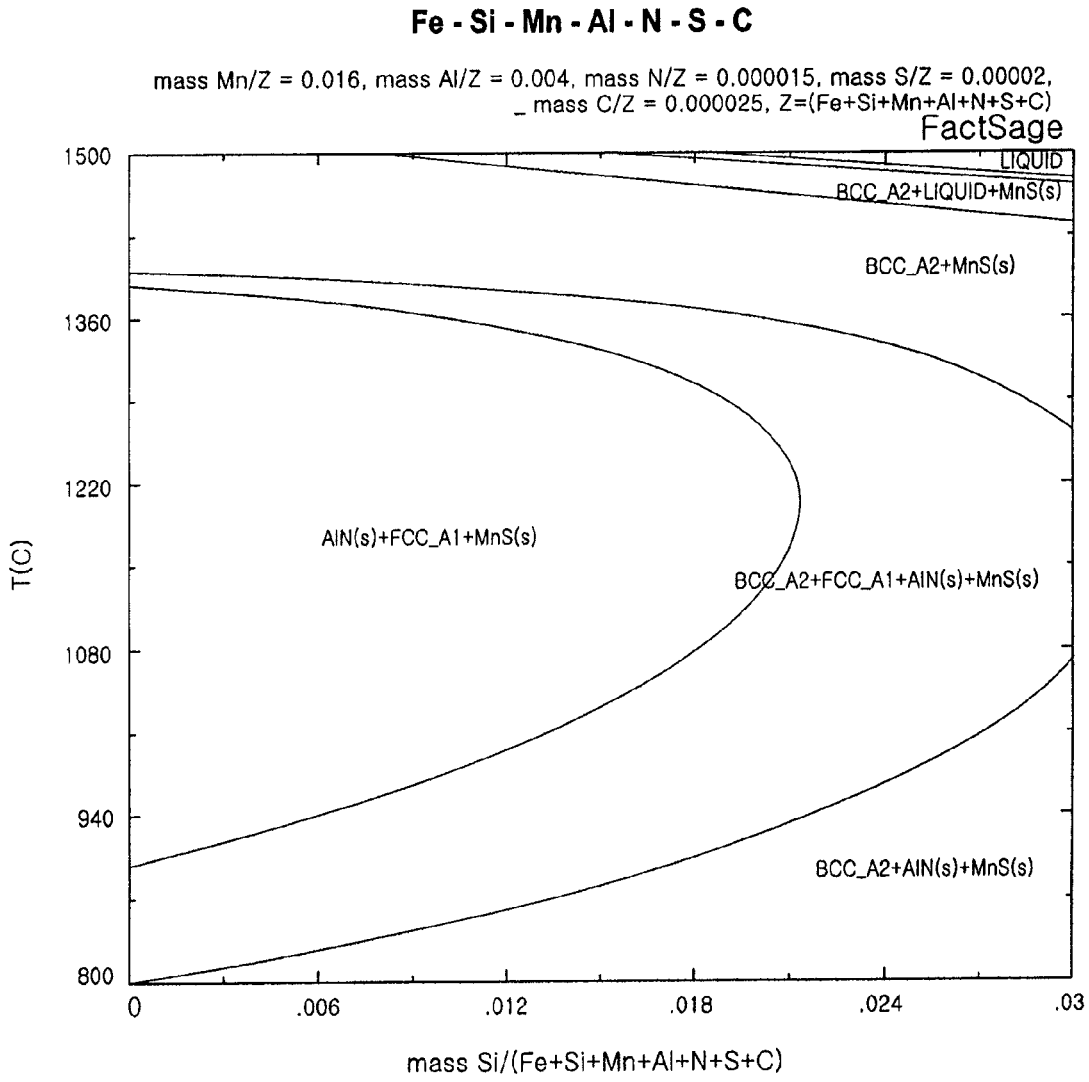

【Fig. 5】
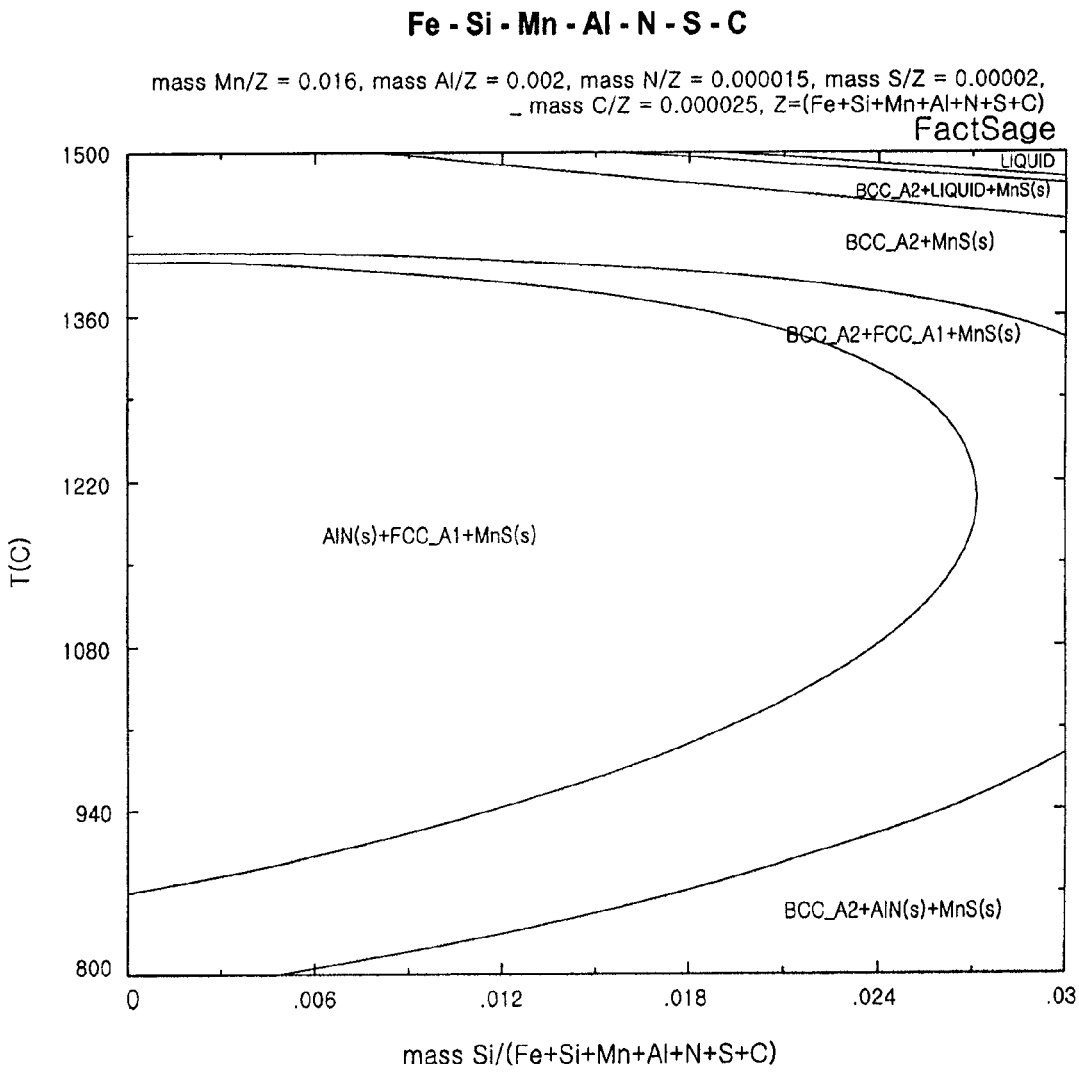

【Fig. 6】
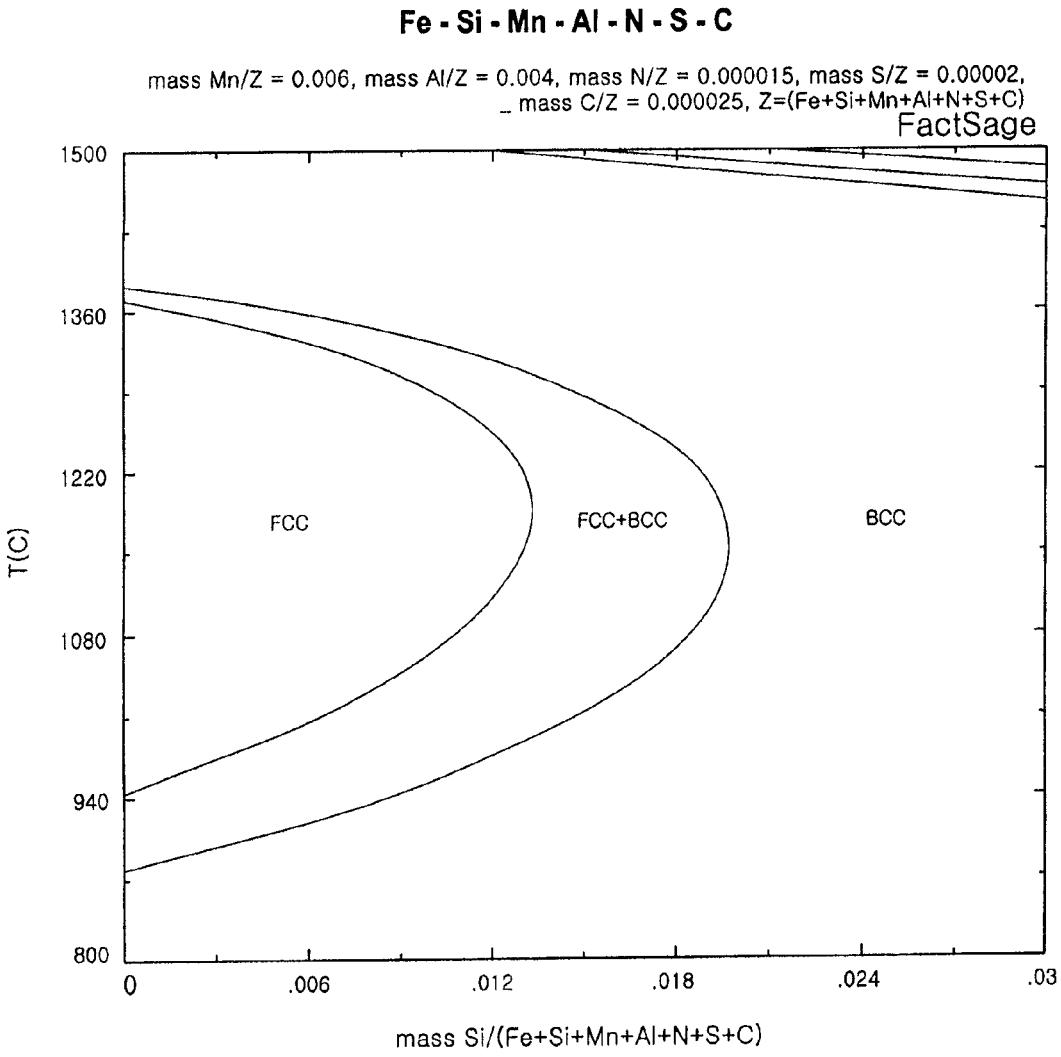

【Fig. 7】
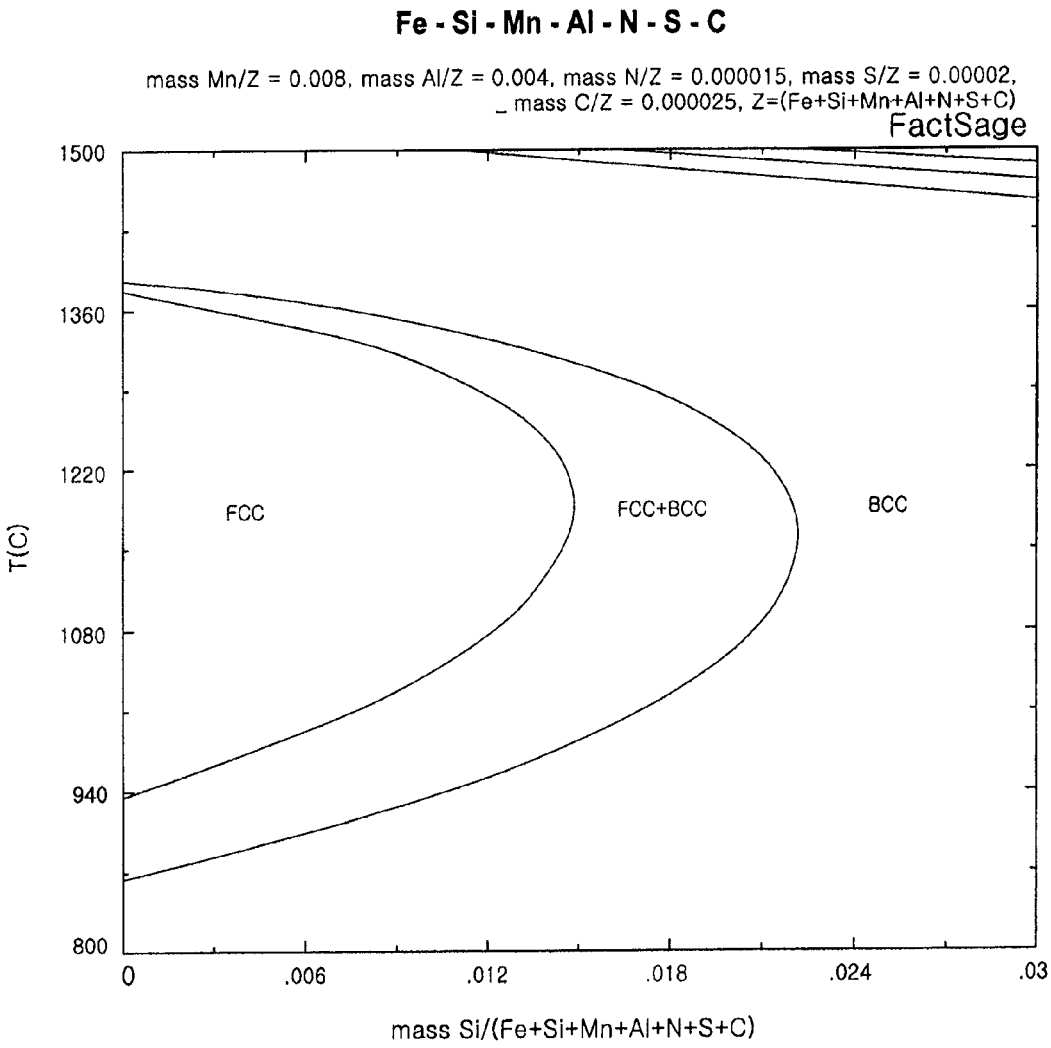

NON-ORIENTED ELECTRICAL STEEL SHEETS WITH EXCELLENT MAGNETIC PROPERTIES AND METHOD FOR MANUFACTURING THE SAME

TECHNICAL FIELD

The present invention relates to non-oriented electrical steel sheets for use as the core of electrical devices, such as motors, transformers and magnetic shields. More particularly, it relates to a non-oriented electrical steel sheet that has reduced iron loss and increased magnetic flux density by controlling alloy component elements and optimizing hot-rolling conditions, even though hot-rolled sheet annealing is not carried out, as well as a manufacturing method thereof.

BACKGROUND ART

Non-oriented electrical steel sheets are important parts required to change electrical energy into mechanical energy in electrical devices. For the reduction of energy, changes in the magnetic properties of the steel sheets, i.e., a reduction in iron loss and an increase in magnetic flux density are required. The iron loss means energy lost as heat in a process of energy transformation, and the magnetic flux density is expressed as force that generate power. If the iron loss is low, energy loss can be reduced, and if the magnetic flux density is high, the copper loss of electrical devices can be reduced, thus making it possible to reduce the size of the electrical devices.

To manufacture a material having low iron loss and high magnetic flux density, the texture of the final annealed steel sheet needs to be improved, and the texture improvement is greatly influenced by component design and hot rolling. Thus, the development of a proper component system and the optimization of hot rolling conditions are needed.

For this purpose, in a conventional manufacturing process, the annealing of hot-rolled sheets is performed to homogenize the texture of hot-rolled sheets and to make grain size coarse. However, the process of annealing the hot-rolled sheets acts as a main cause of cost increase resulting from the addition of processes. Recently, as demand for electrical steel sheets been continuously increased, a need for productivity improvement and cost reduction has been greatly highlighted. Thus, studies on technology of omitting the hot-rolled sheet annealing process, acting as a main cause of cost increase, are actively ongoing.

Japanese Patent Laid-Open Publication No. 6-220537 discloses technology for manufacturing non-oriented electrical steel sheets having improved magnetic properties without carrying out hot-rolled sheet annealing. In the technology according to the patent literature, steel containing 1.8 wt % or less of Si+Al is subjected to hot finishing rolling, in which the rolling reduction ratio is limited to 40% or less at a temperature range from an austenite-to-ferrite transformation start temperature +20° C. to an austenite-to-ferrite transformation end temperature −20° C., and the finish rolling deformation rate is limited to at least 50 s−1. According to the disclosure in the patent, if the above conditions are satisfied, deformation resistance caused by the transformation from austenite to ferrite will be lowered so that rolling will be stabilized and magnetic properties will also be enhanced. However, it is expected that the transformation temperature will be lowered due to a low Si content to make grains fine. Also, the disclosed technology is technology for use in manufacturing electrical steel sheets having an iron loss (W15/50) of about 7.00 and is believed to be favorable for improving the shape of hot-rolled sheets rather than for improvements in magnetic properties.

An example of other prior technologies is Japanese Patent Laid-Open Publication No. 2000-297326. In the prior technology, the condition of rolling pass parameter (Z) is limited to improve magnetic properties. However, the rolling pass parameter value should be 16 or less while its fluctuation range should be 2.0 or less, and for this purpose, the deformation rate of hot rolling should be low and the rolling temperature should be increased. However, since the rolling temperature or the deformation rate is determined depending on the ability of a hot rolling mill, it is not easy to apply various conditions. Also, to satisfy the above condition, there is a problem in that a two-step winding must be performed, which comprises winding at a high temperature followed by rewinding.

As another prior technology, Japanese Patent Laid-Open Publication No. 2002-356752 discloses technology of improving by the optimization of base components and an improvement in the manufacturing process without the addition of special elements, in which the size and number of sulfides and nitrides are especially limited. However, measuring the size and number of the sulfides and nitrides produced during the manufacturing process includes many errors, since a very narrow range of observed values are obtained.

DISCLOSURE OF THE INVENTION

Technical Tasks to be Solved by the Invention

The present invention has been made to solve the above-mentioned problems occurring in the prior art, and it is an object of the present invention to provide a non-oriented electrical steel sheet having reduced iron loss and increased magnetic flux density by suitably controlling the alloy elements and hot rolling process of the non-oriented electrical steel sheet which is subjected or not subjected to hot-rolled sheet annealing.

Technical Solution

To solve the above technical problems, the present inventor has examined the effect of the kind of alloy elements on magnetic properties and phase transformation, and the effect of hot rolling conditions on magnetic properties, and as a result, found that C, Si, Mn and Al among alloy elements greatly influence magnetic properties and phase transformation, and also a phase subjected to hot rolling (austenite, ferrite or a two-phase region of austenite and ferrite), hot finish rolling start temperature and end temperature, the reduction ratio in a final pass, etc., greatly influence magnetic properties.

Also, the present inventor found from the results of studies that, if hot-rolled sheet annealing is omitted, deformation caused by hot rolling will exist in hot-rolled sheets, deformation energy caused by hot-rolled rolling will promote the production of the {111} texture in final annealing and provide recrystallization nucleation sites in the final annealed sheets to make grains fine, thus deteriorating magnetic properties, and that this deformation caused by hot rolling is more accumulated in the case of rolling in the ferrite region than the case of rolling in the austenite region, due to the influence of temperature.

Accordingly, the present inventor has found that, to achieve the above object, it is necessary to reduce deformation energy through the design of alloy elements having a two-phase region of austenite+ferrite and the rolling of the austenite region, and also a hot rolling schedule should be set such that it can minimize deformation energy and make the grains of hot-rolled grains large, thereby completing the present invention.

In one aspect, the present invention provides a non-oriented electrical steel sheet which has excellent magnetic properties, the steel sheet being comprised of 0.005 wt % or less of C, 1.0-3.0 wt % of Si, 0.1-2.0 wt % of Mn, 0.1 wt % or less of P, 0.1-1.5 wt % of Al, and a remainder of Fe and other inevitable impurities, in which the relation between the elements Mn and Al satisfies an equation of $-0.2<m(=Mn-Al)<1.0$, and a slab for the steel sheet, when reheated, has a two-phase region of austenite+ferrite at a temperature ranging from Ar1 to 1250° C.

Preferably, the steel sheet additionally contains 0.007-0.15 wt % of at least one element selected from Sb and Sn, and the impurities contained in the steel sheet are comprised of 0.003 wt % or less of S, 0.003 wt % or less of N, and 0.002 wt % or less of Ti, and the Ar1 temperature of the slab is 960-1060° C.

In another aspect, the present invention provides a method for manufacturing a non-oriented electrical steel sheet, which has excellent magnetic properties while hot-rolled sheet annealing can be omitted, the method comprising the steps of:

reheating a slab comprising 0.005 wt % or less of C, 1.0-3.0 w % of Si, 0.1-2.0 wt % of Mn, 0.1 wt % or less of P, 0.1-1.5 wt % of Al, and a remainder of Fe and other inevitable impurities, to a temperature ranging from Ar1 to 1250° C., in which the relationship between the elements Mn and Al satisfies an equation of $-0.2<m(=Mn-Al)<1.0$;

hot-rolling the reheated slab in a two-phase region of austenite+ferrite to more than 70% of the total hot finish rolling and then hot-rolling the slab in a single phase region of ferrite to 30% or less of the total hot finish rolling, in such a manner that the reduction ratio in a final pass is {20−(960−finish rolling end temperature)/20}% or less;

winding the hot-rolled sheet at a temperature of 650~800° C.;

cold-rolling the wound sheet to a predetermined thickness; and subjecting the cold-rolled steel sheet to final annealing.

Preferably, the slab additionally comprises 0.007-0.15 wt % of at least one element selected from Sb and Sn, and the impurities contained in the steel sheets are comprised of 0.003 wt % or less of S, 0.003 wt % or less of N, and 0.002 wt % or less of Ti. Also, the final annealing step is preferably carried out at a temperature elevation rate of 10-40° C./sec, and the Ar1 temperature of the slab is 960~1060° C. In addition, the start temperature of the hot finish rolling is Ar1+50° C. or more, and the end temperature of the hot finish rolling is Ar1−80° C. or more.

Advantageous Effects

According to the present invention, by controlling the contents of alloy component elements and the conditions of hot rolling, the grain size of a hot-rolled sheet can be made uniform using phase transformation at high temperature. Particularly, by controlling the reduction ratio in hot rolling to reduce the accumulation of deformation energy in the hot-rolled sheet, nucleation of the {111} texture unfavorable for magnetic properties in the final annealing after cold rolling can be suppressed, and so a non-oriented electrical steel sheet having excellent magnetic properties can be manufactured.

BRIEF DESCRIPTION OF DRAWINGS

FIGS. 1 to 7 are phase transformation diagrams of the inventive steels and comparative steels, calculated using the FactSage program, in which:

FIG. 1 is a phase transformation diagram obtained by fixing the content of Mn to 0.3% and the content of Al to 0.6%, and changing the content of Si;

FIG. 2 is a phase transformation diagram obtained by fixing the contents of Mn and Al to 0.4% and changing the content of Si;

FIG. 3 is a phase transformation diagram obtained by fixing the content of Mn to 1.6% and the content of Al to 0.8% and changing the content of Si;

FIG. 4 is a phase transformation diagram obtained by the content of Mn to 1.6% and the content of Al to 0.4% and changing the content of Si;

FIG. 5 is a phase transformation diagram obtained by fixing the content of Mn to 1.6% and the content of Al to 0.2% and changing the content of Si;

FIG. 6 is a phase transformation diagram obtained by fixing the content of Mn to 0.6% and the content of Al to 0.4% and changing the content of Si; and FIG. 7 is a phase transformation diagram obtained by fixing the content of Mn to 0.8% and the content of Al to 0.4% and changing the content of Si.

BEST MODE FOR CARRYING OUT THE INVENTION

Hereinafter, the present invention will be described in detail.

Si and Al are ferrite-forming elements, and C and Mn are austenite-forming elements. Thus, to make the austenite+ferrite two-phase region, it is necessary to reduce the contents of Si and Al and to increase the contents of C and Mn. However, Si and Al are elements having high resistivity, and thus, if they are too much reduced, iron loss will be deteriorated. Accordingly, it is necessary to set a proper component system. Also, if the content of element C is increased, the austenite fraction will be increased but element C will cause magnetic aging in the final annealed sheet to deteriorate magnetic properties. Accordingly, an additional process of decarburization is required in final annealing.

Also, among impurity elements, N and S bind to Al and Mn to form fine nitride and sulfide of AlN and MnS, respectively, so that they suppress the growth of grains and promote the texture of the {111} plane unfavorable for magnetic properties. To reduce the effect of element N, it is preferable to reduce element N by the control of impurities or to add element Al as much as possible. This element Al suppresses the formation of fine AlN from element N to help the growth of grains and to increase resistivity, thus reducing iron loss. To reduce the effect of element S, it is preferable to add Mn as much as possible, and this element Mn suppresses the formation of fine MnS from element S to help the growth of grains.

The austenite fraction is determined depending on the contents of C, Si, Al and Mn, and when the contents of C, Al and Mn are fixed, the austenite fraction can be controlled by controlling the content of Si. Thus, it is needed to set the content of Si suitable to make a two-phase region, in which case, if the Si content is too low, iron loss will be deteriorated due to a reduction in resistivity, and an austenite single-phase will be formed during reheating to promote the solid dissolution of AlN and MnS precipitates, so that the number of fine re-precipitates in hot rolling and winding will be increased to deteriorate magnetic properties. On the other hand, if the Si content is too large, it will form a ferrite single-phase during reheating to increase the accumulation of deformation energy caused by hot rolling so as to make grains fine after final annealing and promote the production of the {111} texture unfavorable for magnetic properties, thus deteriorating magnetic properties. For this reason, the design is performed such that the Mn/Al ratio is controlled to sufficiently secure the austenite region, and then the Si content is controlled such that a steel slag has an austenite+ferrite two-phase region during reheating while the Ar1 temperature reaches 960~1060° C.

Hereinafter, the reasons for the limitation of the contents of elements according to the present invention will be described.

C: 0.005 wt % or less

It is known that, since the element C causes magnetic aging in a final product so as to deteriorate the magnetic properties of the product during use, a lower content of element C is generally preferable for magnetic properties. Thus, magnetic properties are improved by reducing the content of element C in a step of refining steel, and causing it to be contained in a slab in an amount of 0.005 wt % or less. If it is contained in the slab in an amount of 0.005 wt % or more, the cold-rolled sheet must be subjected to decarburization annealing before final annealing, in which case a wet atmosphere will be used, and thus an oxide layer will be formed on the sheet surface to deteriorate magnetic properties. For this reason, the element C is contained in the slab in an amount of 0.005 wt % or less. When the element C is contained in the final product in an amount of 0.003 wt % or less, if possible, the magnetic aging in the final product can be suppressed.

Si: 1.0-3.0 wt %

The element Si is an element that increases resistivity to lower the eddy current loss in iron losses, but if it is added in an amount of more than 3.0 wt %, it will result in steel that is difficult to cold roll and has a ferrite single-phase where phase transformation does not occur. For this reason, the element Si is preferably limited to 3.0 wt % or less.

Mn: 0.1-2.0 wt %

The element Mn, an austenite-forming element, is an element that increases resistivity and improves texture, and if it is added in an amount of more than 2.0 wt %, the effect of magnetic property improvement will be saturated. For this reason, the content of the element Mn is preferably limited to 0.1-2.0 wt %.

P: 0.1 wt % or less

The element P is an element that increases resistivity, is segregated in grains and develops texture. If hot-rolled sheet annealing is carried out, the element P should be added in an amount of at least 0.01 wt % to show its effect, and if it is added in a large amount, it will make cold rolling difficult and increase segregation to deteriorate magnetic properties. For this reason, the content of the element P is preferably to limited to 0.1 wt % or less. If hot-rolled sheet annealing is not carried out, the element P will not be uniformly distributed in the grain boundary, and so cannot obtain the above effect and will interfere with the growth of grains. Accordingly, the content of the element P is preferably minimized.

Al: 0.1-1.5 wt %

The element Al, a ferrite-forming element, is an element effective in increasing resistivity to reduce eddy current loss. If it is added in an amount of 0.1 wt % or less, the effects of its addition will not be shown, and if it is added in an amount of more than 1.5 wt %, the degree of magnetic property improvement will be insufficient in view of the amount of added Al, and cold-rolling property will be deteriorated. For this reason, the content of the element Al is preferably limited to 0.1-1.5 wt %. Since the element Al is a ferrite-forming element, it is added considering the Mn content in order to design steel where suitable phase transformation occurs. Also, when Al is added in an amount of 0.2-1.0 wt %, its effect will be further increased. This is because the addition of Al greatly reduces the effect of oxygen and transforms fine AlN deposits into coarse AlN deposits.

$$-0.2<m(=\mathrm{Mn}-\mathrm{Al})<1.0$$

If m is lower than −0.2, an austenite region will be too small so as to make it impossible to form an austenite region having a suitable or larger area, and if m is 1.0 or more, the austenite region will be too large so as to excessively increase the content of Si having a suitable Ar1 temperature. For this reason, m is limited to a range from −0.2 to 1.0.

In addition to the above elements, the inventive steel is comprised of a remainder of Fe and other inevitable impurities.

In the present invention, the reason why the Si content is controlled such that the austenite+ferrite dual-phase is formed during reheating while the Ar1 temperature reaches 960~1060° C. is that, if the Ar1 temperature is too high, hot finish rolling will not be ended at a temperature of Ar1−80° C. or more due to facility problems, so that the rolling reduction in the ferrite region will be increased to increase deformation energy caused by hot rolling so as to promote the production of the {111} texture, and if the Ar1 temperature is too low, a micrograph having small grains will be formed during the phase transformation from austenite to ferrite so as to deteriorate magnetic properties. When the hot finish rolling is carried out in the two-phase region, grains will be coarse due to an exothermic reaction caused by the austenite-to-ferrite phase transformation, and uniform grains can be obtained throughout the hot-rolled sheet due to the phase transformation. If the hot rolling finish temperature is high and the reduction ratio in the final pass is low, a grain which is coarser and uniform in the sheet thickness direction can be obtained.

Sb and Sn: 0.007-0.15 wt %

The elements Sb and Sn are elements which are segregated in the grain boundary and suppress the {222} texture unfavorable for magnetic properties, and these elements are concentrated on the surface of a steel sheet to suppress the nitrification of the steel. Thus, these elements inhibit the formation of fine grains and allow uniform grains to be formed. If these elements are added in an amount of 0.007 wt % or less, their effect will be insufficient, and if they are added in an amount of 0.15 wt % or more, they will suppress the growth of grains, make cold rolling difficult, and reduce the degree of improvement of magnetic properties. For this reason, the content of these elements is preferably limited to 0.007-0.15 wt %.

S: 0.003 wt % or less

The element S forms fine precipitates of MnS to deteriorate magnetic properties, and thus is advantageously added to an amount as low as possible. If it is added in an amount of more than 0.003 wt %, it will highly deteriorate magnetic properties. For this reason, the content of the element S is preferably limited to 0.003 wt % or less.

N: 0.003 wt % or less

The element N forms fine long AlN precipitate and binds to Nb to make fine precipitate of NbN. For this reason, it is contained in an amount as low as possible, and in the present invention, it is preferably limited to 0.003 wt % or less.

Nb: 0.002 wt % or less

The element Nb forms fine NbN deposits to suppress the growth of grains and develops the texture of the {222} plane unfavorable for magnetic properties. For this reason, it is limited to 0.002 wt % or less. Also, since it binds to element C to make fine carbides, the content of the element C in a slab needs to be reduced, if possible. Since the influence of the addition amount of this element Nb is very great, the element Nb is preferably contained in an amount of 0.002 wt % or less in view of magnetic properties.

Ti: 0.002 wt % or less

The element Ti forms fine deposits of TiC and TiN to suppress the growth of grains and develop the texture of the {222} plane unfavorable for the magnetic properties of steel sheets. For this reason, the element Ti is limited to 0.002 wt % or less.

Hereinafter, the manufacturing method according to the present invention will be described.

The inventive manufacturing method comprises: reheating a slab having the above-mentioned element composition to a temperature of Ar1~1250° C.; starting the hot finish rolling of the reheated slab in the austenite+ferrite dual-phase region and finishing the hot finish rolling in the ferrite phase; winding the rolled sheet at a temperature of 650~800° C.; performing or not performing the annealing of the hot-rolled sheet; pickling the resulting sheet; and subjecting the pickled sheet to cold rolling and final annealing.

In the present invention, in order to minimize deformation energy caused by hot rolling and to grow grains, the hot finish rolling is started in the austenite+ferrite two-phase region at a temperature of Ar1+50° C. or more, and is finished in the ferrite region at a temperature of Ar1−80° C. or more.

Also, 70% or more of the total hot finish rolling is performed in the two-phase region, the rolling reduction in the ferrite single-phase region is performed to 30% or less of the total hot finish rolling, and the rolling reduction in the final pass is performed to {20−(960−finish rolling end temperature)/20}% or less at a temperature of Ar1−80° C. or more. By adopting this hot rolling schedule, the object of the present invention can be achieved.

It was found that, if the hot rolling was carried out by this rolling schedule, grains on the surface of the hot rolled sheet would be made coarse to improve magnetic properties.

The reason why the steel slab having the above-described composition is reheated at a temperature of Ar1~1250° C. or more and then hot-rolled is that, if the reheating temperature is too high, the amount of solid solution of AlN or MnS will be increased, and the solid solubility of AlN and MnS in the austenite region will be higher than the solid solubility in the ferrite region, and the fine reprecipitation of AlN and MnS solid-dissolved during hot rolling and winding will interfere with the growth of grains. Also, the reason why the design is performed such that the Ar1 temperature reaches 960~1060° C. is that, if the Ar1 temperature is too high, the ferrite region will be enlarged to make it impossible to show the effect of rolling in the two-phase region, and the hot finish rolling will not be ended at a temperature of Ar1−80° C. or more due to facility problems to increase the rolling reduction in the ferrite region, so that deformation energy caused by hot rolling will be increased to promote the formation of the {111} texture, and if the Ar1 temperature is too low, small grains will be formed during the phase transformation from austenite to ferrite to deteriorate magnetic properties. Also, the reason why the hot finish rolling is started in the austenite+ferrite two-phase region at a temperature of Ar1+50° C. or more is that, if the hot finish rolling start temperature is low, the temperature of the final pass will be low to interfere with the growth of grains, and for this reason, the hot finish rolling start temperature is set to a temperature of Ar1+50° C. or more, and if the hot finish rolling is carried out in the two-phase region, grains will be coarse due to an exothermic reaction caused by the austenite-to-ferrite phase transformation, and uniform grains can be obtained throughout the hot-rolled sheet due to the phase transformation.

Also, the reason why the rolling reduction in the ferrite single-phase is performed to 30% or less of the total hot finish rolling and the rolling ratio in the final pass is performed to {20−(960−finish rolling end temperature)/20}% or less at a temperature of Ar1−80° C. or more is that, if the final pass is subjected to weak rolling reduction in the ferrite reduction, small residual stress will exist so that winding at a temperature of 650° C. or more will promote the growth of grains.

The hot-rolled sheet manufactured as described above is wound at a temperature of 650~800° C., and then cooled either in a coiled state in air or in a non-oxidative atmosphere. If the winding temperature is more than 800° C., oxidation in the cooling step will be increased to adversely affect acid pickling, and for this reason, the winding temperature is preferably limited to 800° C. or less. Also, if the winding temperature is 650° C. or less, the growth of grains will be insufficient, and for this reason, the sheet is wound at a temperature ranging from 650° C. to 800° C.

The wound sheet is directly cold rolled without carrying out hot-rolled sheet annealing. However, if necessary, the wound sheet may also be pickled with acid and cold-rolled, after annealing it.

The cold rolling can be performed either by a one-step cold rolling process or a two-step cold rolling process consisting of first cold rolling, interannealing and then second cold rolling.

The steel sheet cold-rolled to the desired thickness is subjected to final annealing at a temperature of 800° C. to Ar1+50° C. at a temperature elevation rate of 10-40° C./sec. If the final annealing temperature is 800° C. or less, the growth of grains will be insufficient, and if it is more than Ar1+50° C., the temperature of the sheet surface will be excessively increased to make the sheet shape bad and to cause surface defects, and grains can become fine due to the excessive phase transformation from ferrite to austenite.

The reason why the temperature elevation temperature is limited to 10-40° C./sec is that this temperature range results in an increase in the formation of the {200} plane favorable for magnetic properties in the texture of the material. If the temperature elevation rate is 10° C./sec or less, the {222} and {112} textures will be developed to deteriorate magnetic properties, and if it is more than 40° C./sec, the sheet shape becomes bad.

Also, the annealing is carried out in a dry non-oxidative atmosphere having no humidity. If moisture exists, oxygen in the moisture will bind to the element C of the steel to allow the steel to be decarburized, but the element oxygen will bind to the elements Si, Al, etc. of the steel sheet to form an oxide layer in the steel sheet to deteriorate magnetic properties, and for this reason, the annealing is carried out in a dry reducing atmosphere. The annealed sheet is coated with an insulating coating film and then shipped to users. The insulating coating film may be made of an organic material, an inorganic material, an organic/inorganic composite material, and other insulating coating materials.

Hereinafter, the present invention will be described in detail by examples.

Example 1

Each of steel slabs having compositions shown in Table 1 below was reheated at a temperature of 1180° C., and hot-rolled to 2.5 mm and then wound and cooled in air at a temperature of 720° C. The wound and cooled steel sheets were pickled with acid and then cold-rolled to a thickness of 0.5 mm. The cold-rolled steel sheets were subjected to final annealing at temperatures of 1000° C. (steels 1 and 2) and 900° C. (steels 3, 4 and 5) in a mixed gas atmosphere of 30% hydrogen and 70% nitrogen for 90 seconds. The annealed sheets were cut and then examined for magnetic properties, and the results are shown in Table 2 below.

FIGS. 1 to 5 show the phase transformation of each of the steels, caused by changes in the contents of Si, Al and Mn. FIGS. 1 to 5 show phase changes with changes in temperature (y-axis) and Si content (x-axis), calculated using the FactSage program. m (=Mn−Al) values are −0.3 for steel 1, 0 for steel 2, 0.8 for steel 3, 1.2 for steel 4, and 1.4 for steel 5.

Steels 1 and 2 have similar resistivities, but steel 2 has a higher austenite fraction due to a difference in component ratio. As a result, in the case of steel 1, the reduction ratio in the ferrite region was increased. So the grain size of the hot-rolled sheet was fine and elongated then the magnetic properties were deteriorated. Steels 3, 4 and 5 have similar resistivities; however, due to the contents of Si, Al and Mn, in the reheating step, steel 3 has a two-phase region, and steels 4 and 5 have an austenite single-phase region. Also, steel 3 has the highest transformation temperature of 990° C. Steels 4 and 5 have an austenite phase in reheating and also an excessively low transformation temperature, so that the grains of the hot-rolled sheets are fine, and thus the magnetic properties are poor. Thus, to provide a suitable texture intended in the present invention, a component system satisfying a relation of $-0.2<m<1.0$ and having an Ar1 temperature of 960~1060° C. and a two-phase region upon reheating needs to be set. In the above relation, if m is −0.2 or less, the austenite region will be excessively reduced to make it impossible to form a two-phase region, and if m is 1.0 or more, the austenite region will be excessively increased, resulting in an excessive increase in the content of Si having a suitable Ar1 temperature.

TABLE 1

| Steels | C | Si | Mn | Al | P | Fe |
|---|---|---|---|---|---|---|
| 1 | 0.0025 | 1.0 | 0.30 | 0.60 | 0.010 | Bal |
| 2 | 0.0026 | 1.30 | 0.40 | 0.40 | 0.010 | Bal |
| 3 | 0.0025 | 1.60 | 1.60 | 0.80 | 0.011 | Bal |
| 4 | 0.0026 | 2.0 | 1.60 | 0.40 | 0.010 | Bal |
| 5 | 0.0023 | 2.4 | 1.60 | 0.20 | 0.009 | Bal |

TABLE 2

| Steels | Phase in reheating | m | Ar1 | W15/50 (W/kg) | B50(T) | Remark |
|---|---|---|---|---|---|---|
| 1 | gamma + alpha | −0.3 | 1055 | 3.98 | 1.733 | Comparative |
| 2 | gamma + alpha | 0 | 1017 | 3.65 | 1.755 | Inventive |
| 3 | gamma + alpha | 0.8 | 990 | 2.72 | 1.693 | Inventive |
| 4 | gamma | 1.2 | 918 | 2.91 | 1.671 | Comparative |
| 5 | gamma | 1.4 | 916 | 2.80 | 1.668 | Comparative |

$W_{15/50}$: loss occurring when magnetized with 1.5 Tesla at 50 Hz.

$B_{50}$: magnetic flux density occurring when a magnetic field of 5000 Å/m at 50 Hz was applied.

Example 2

Each of steel slabs having compositions shown in Table 3 below was reheated at a temperature of 1180° C., and hot-rolled to 2.5 mm and then wound and cooled in air at a temperature of 720° C. The wound and cooled steel sheets were pickled with acid and then cold-rolled to a thickness of 0.5 mm. The cold-rolled steel sheets were subjected to final annealing at temperatures of 1000° C. in a mixed gas atmosphere of 30% hydrogen and 70% nitrogen for 90 seconds. The annealed sheets were cut and examined for magnetic properties, and the results are shown in Table 4 below.

TABLE 3

| Steels | C | Si | Mn | Al | P | Fe |
|---|---|---|---|---|---|---|
| 6 | 0.0025 | 1.2 | 0.6 | 0.4 | 0.010 | Bal. |
| 7 | 0.0026 | 1.6 | 0.6 | 0.4 | 0.010 | Bal. |
| 8 | 0.0025 | 1.9 | 0.6 | 0.4 | 0.011 | Bal. |
| 9 | 0.0026 | 1.4 | 0.8 | 0.4 | 0.010 | Bal. |
| 10 | 0.0024 | 1.7 | 0.8 | 0.4 | 0.010 | Bal. |
| 11 | 0.0025 | 2.2 | 0.8 | 0.4 | 0.010 | Bal. |
| 12 | 0.0017 | 2.02 | 0.12 | 0.21 | 0.01 | Bal. |

TABLE 4

| Steels | Phase in reheating | m | Ar1 | W15/50 (W/kg) | B50(T) | Remark |
|---|---|---|---|---|---|---|
| 6 | Gamma | 0.2 | 973 | 3.65 | 1.734 | Comparative |
| 7 | gamma + alpha | 0.2 | 1030 | 3.04 | 1.743 | Inventive |
| 8 | gamma + alpha | 0.2 | 1100 | 3.20 | 1.711 | Comparative |
| 9 | Gamma | 0.4 | 970 | 3.55 | 1.726 | Comparative |
| 10 | gamma + alpha | 0.4 | 1005 | 2.87 | 1.735 | Inventive |
| 11 | Alpha | 0.4 | — | 3.05 | 1.674 | Comparative |
| 12 | Alpha | −0.09 | — | 3.5 | 1.725 | Comparative |

$W_{15/50}$: loss occurring when magnetized with 1.5 Tesla at 50 Hz.

$B_{50}$: magnetic flux density occurring when a magnetic field of 5000 A/m at 50 Hz was applied.

FIGS. 6 and 7 show the phase transformation of each of the steels. FIGS. 6 and 7 show phase changes with changes in temperature (y-axis) and Si content (x-axis), calculated using the FactSage program.

FIG. 6 shows the results for steels 6, 7 and 8 containing 0.6 wt % Mn and 0.4 wt % Al and having Si contents of 1.2, 1.6 and 1.9 wt %, respectively. As shown in FIG. 6, upon reheating at 1180° C., steel 6 has an austenite (gamma) single-phase region, and steels 7 and 8 have an austenite+ferrite two-phase region. The Ar1 temperatures are shown in Table 4.

FIG. 7 shows the results for steels 9, 10 and 11 containing 0.8 wt % Mn and 0.4 wt % Al and having Si contents of 1.4, 1.7 and 2.2 wt %, respectively. As shown in FIG. 7, upon reheating at 1180° C., steel 9 has an austenite (gamma) single-phase region, steel 10 has an austenite+ferrite two-phase region, and steel 11 has a ferrite single-phase region. The Ar1 temperatures are shown in Table 4.

As can be seen in Table 4 above, the inventive materials manufactured according to the inventive manufacturing conditions using the inventive steels (7 and 10) satisfying the components and hot-rolling conditions of the present invention have low iron loss and high magnetic flux densities as compared to the comparative steels (6, 8, 9 and 11). Steel 6 was lower in Si content than those of steels 7 and 8, and thus was hot rolled in an austenite single-phase. As a result, the magnetic flux density of steel 6 was maintained at a level similar to those of steels 7 and 8, but the iron loss was significantly increased. Steel 8 had a two-phase region upon reheating, but the hot finish rolling was made mainly in a ferrite region due to a high Ar1 temperature, leading to a reduction in the magnetic flux density. Steel 9 had an austenite single-phase region upon reheating, and the hot finish rolling was performed in a two-phase region; however, the grains of the hot-rolled sheet became fine due to a low Ar1 temperature, leading to an increase in the iron loss and a reduction in the magnetic flux density.

Steel 12 is a prior example disclosed in Japanese Patent Laid-Open Publication No. 2000-297326, which is a composition having a ferrite single-phase upon reheating. If it is hot-rolled in conditions similar to steels 1-9, it will show the following properties inferior to those of the inventive materials: Z parameter: about 15.5; iron loss: 3.5 W/kg; and magnetic flux density: 1.725 T.

Slabs for steels 7, 10 and 12 shown in Table 3 above were reheated at a temperature of 1180° C., hot-rolled to 2.5 mm, and then wound and cooled in air at 720° C. The wound and cooled steel sheets were annealed at 1000° C. for 5 minutes and then pickled with acid, followed by cold-rolling to a thickness of 0.5 mm. The cold-rolled steel sheets were subjected to final annealing at a temperature of 1000° C. in a mixed gas atmosphere of 30% hydrogen and 70% nitrogen for 90 seconds. The annealed sheets were cut and then examined for magnetic properties, and the results are shown in Table 5 below. As can be seen in Table 5, if the hot-rolled sheet annealing was carried out, more excellent magnetic properties would be obtained.

TABLE 5

| Steels | Phase in reheating | m | Ar1 | W15/50 (W/kg) | B50(T) | Remark |
|---|---|---|---|---|---|---|
| 7 | gamma + alpha | 0.2 | 1030 | 2.82 | 1.757 | Inventive |
| 10 | gamma + alpha | 0.4 | 1005 | 2.67 | 1.745 | Inventive |
| 12 | Alpha | −0.09 | — | 3.23 | 1.736 | Comparative |

$W_{15/50}$: loss occurring when magnetized with 1.5 Tesla at 50 Hz.

$B_{50}$: magnetic flux density occurring when a magnetic field of 5000 A/m at 50 Hz was applied.

Example 3

Slabs for steels 7 and 10 were reheated at 1180° C., hot-rolled to a final thickness of 2.5 mm while changing the conditions of hot finish rolling as shown in Table 6 below, and then wound as shown in Table 6. The hot rolled sheets were pickled with acid without carrying out annealing, and then cold-rolled to a thickness of 0.5 mm. The cold-rolled steel sheets were annealed at 1000° C. in a mixed gas atmosphere of 30% hydrogen and 70% nitrogen for 90 seconds. The annealed sheets were cut and then examined for magnetic properties, and the results are shown in Table 6 below.

TABLE 6

| No. | Steel | Fraction of rolling in two-phase region to total hot finish rolling(%) | Final pass temp. (° C.) | Reduction ratio in final pass (%) | Winding temp. (° C.) | Iron loss (W15/50) (W/kg) | Magnetic flux density (B50) (Tesla) | Remark |
|---|---|---|---|---|---|---|---|---|
| 1 | 7 | 93.5 | 960 | 9.7 | 720 | 3.04 | 1.753 | Inven. |
| 2 | 7 | 80.6 | 965 | 10.0 | 720 | 3.08 | 1.751 | Inven. |
| 3 | 7 | 65.9 | 967 | 10.4 | 720 | 3.47 | 1.730 | Comp. |
| 4 | 7 | 90.2 | 952 | 10.1 | 720 | 3.10 | 1.755 | Inven. |
| 5 | 7 | 90.5 | 887 | 11.3 | 720 | 3.25 | 1.733 | Comp. |
| 6 | 7 | 92.0 | 961 | 30.0 | 720 | 3.21 | 1.735 | Comp. |
| 7 | 7 | 92.7 | 970 | 50.3 | 720 | 3.46 | 1.723 | Comp. |
| 8 | 7 | 89.7 | 965 | 10.8 | 680 | 3.15 | 1.749 | Inven. |
| 9 | 7 | 89.7 | 965 | 10.8 | 620 | 3.34 | 1.735 | Comp. |
| 10 | 10 | 92.7 | 968 | 10.7 | 720 | 2.87 | 1.735 | Inven. |
| 11 | 10 | 80.8 | 972 | 11.2 | 720 | 2.86 | 1.733 | Inven. |
| 12 | 10 | 66.1 | 971 | 11.5 | 720 | 3.02 | 1.721 | Comp. |
| 13 | 10 | 91.1 | 950 | 10.6 | 720 | 2.84 | 1.731 | Inven. |
| 14 | 10 | 90.3 | 890 | 10.2 | 720 | 3.09 | 1.718 | Comp. |
| 15 | 10 | 93.5 | 967 | 30.6 | 720 | 3.17 | 1.722 | Comp. |
| 16 | 10 | 92.2 | 966 | 50.0 | 720 | 3.25 | 1.705 | Comp. |
| 17 | 10 | 91.0 | 968 | 10.7 | 680 | 2.92 | 1.733 | Inven. |
| 18 | 10 | 91.0 | 968 | 10.7 | 620 | 3.17 | 1.728 | Comp. |

$W_{15/50}$: loss occurring when magnetized with 1.5 Tesla at 50 Hz.

$B_{50}$: magnetic flux density occurring when a magnetic field of 5000 A/m at 50 Hz was applied.

The comparative steel materials 3 and 12 had a low rolling reduction in a two-phase region and a high rolling reduction in the ferrite region, compared to the inventive steel materials 1, 2, 10 and 11, and thus the hot rolled sheets had much deformation energy caused by hot rolling. Also, a non-recrystallized region was large so that, in final annealing after cold rolling, the {111} texture was developed. Also, recrystallized grains were small, leading to an increase in iron loss and a decrease in the magnetic flux density. The comparative steel materials 5 and 14 were lower in the final pass temperature than the inventive steel materials 4 and 13, so that the growth of grains was suppressed to deteriorate magnetic properties. In the case of the comparative steel materials 6, 7, 15 and 16, the reduction ratio in the final pass was high so that grains on the surface thereof were fine, and the accumulation of deformation energy by hot rolling was increased to deteriorate magnetic properties. Particularly, the magnetic flux density was much reduced. The comparative materials 9 and 18 were lower in the winding temperature than the inventive steel materials, so that the grains of the hot-rolled sheets were not sufficiently grown to deteriorate magnetic properties. However, the effect of the winding temperature was lower than the other conditions.

Example 4

Steel slabs having compositions shown in Table 7 below were reheated at a temperature of 1180° C., and then subjected to hot finish rolling, in such a manner that 80% of the total reduction ratio was performed in the austenite-ferrite two-phase region, and the remaining reduction ratio was performed in the ferrite single-phase region, but the final pass was performed at a temperature of 960° C. to 10%. Then, the hot-rolled sheets were wound at a temperature of 720° C. The wound steel sheets were subjected to cold rolling and final annealing. The annealed sheets were cut and then examined for magnetic properties, and the results are shown in Table 8.

TABLE 7

| Steels | C | Si | Mn | Al | P | Sn | Sb | Fe |
|---|---|---|---|---|---|---|---|---|
| 13 | 0.0026 | 1.6 | 0.6 | 0.4 | 0.010 | 0.005 | — | Bal |
| 14 | 0.0024 | 1.6 | 0.6 | 0.4 | 0.010 | 0.03 | — | Bal |
| 15 | 0.0025 | 1.6 | 0.6 | 0.4 | 0.009 | 0.09 | — | Bal |
| 16 | 0.0022 | 1.6 | 0.6 | 0.4 | 0.010 | 0.20 | — | Bal |
| 17 | 0.0024 | 1.7 | 0.8 | 0.4 | 0.011 | — | 0.004 | Bal |
| 18 | 0.0023 | 1.7 | 0.8 | 0.4 | 0.010 | — | 0.02 | Bal |
| 19 | 0.0026 | 1.7 | 0.8 | 0.4 | 0.010 | — | 0.07 | Bal |
| 20 | 0.0023 | 1.7 | 0.8 | 0.4 | 0.010 | — | 0.20 | Bal |

TABLE 8

| Steels | Phase in reheating | m | Ar1 | W15/50 (W/kg) | B50(T) | Remark |
|---|---|---|---|---|---|---|
| 13 | gamma + alpha | 0.2 | 1030 | 3.04 | 1.743 | Comparative |
| 14 | gamma + alpha | 0.2 | 1030 | 2.99 | 1.752 | Inventive |
| 15 | gamma + alpha | 0.2 | 1030 | 2.93 | 1.756 | Inventive |
| 16 | gamma + alpha | 0.2 | 1030 | 3.26 | 1.750 | Comparative |
| 17 | gamma + alpha | 0.4 | 1005 | 2.87 | 1.735 | Comparative |
| 18 | gamma + alpha | 0.4 | 1005 | 2.83 | 1.743 | Inventive |
| 19 | gamma + alpha | 0.4 | 1005 | 2.81 | 1.747 | Inventive |
| 20 | gamma + alpha | 0.4 | 1005 | 3.12 | 1.745 | Comparative |

$W_{15/50}$: loss occurring when magnetized with 1.5 Tesla at 50 Hz.

$B_{50}$: magnetic flux density occurring when a magnetic field of 5000 A/m at 50 Hz was applied.

As can be seen in Table 8, steels 14, 16, 18 and 19 containing Sn and Sb in amounts within the inventive range were excellent in iron loss and magnetic flux density compared to the comparative steels 13, 16, 17, and 20.

Example 5

Steel slabs having compositions shown in Table 9 were reheated at a temperature of 1180° C., and then subjected to hot finish rolling, in such a manner that 80% of the total reduction ratio was performed in the austenite+ferrite two-phase region, and the remaining reduction ratio was performed in the ferrite single-phase region, but the final pass was performed at a temperature of 960° C. to 10%. The hot-rolled sheets were wound at a temperature of 720° C. The wound steel sheets were subjected to cold rolling and final annealing. The annealed sheets were cut and then examined for magnetic properties, and the results are shown in Table 10 below.

TABLE 9

| Steels | C | Si | Mn | Al | P | S | N | Nb | Ti | Fe |
|---|---|---|---|---|---|---|---|---|---|---|
| 21 | 0.0026 | 1.6 | 0.6 | 0.4 | 0.010 | 0.002 | — | | | Bal |
| 22 | 0.0024 | 1.6 | 0.6 | 0.4 | 0.010 | 0.005 | — | | | Bal |
| 23 | 0.0025 | 1.6 | 0.6 | 0.4 | 0.009 | | 0.002 | | | Bal |
| 24 | 0.0022 | 1.6 | 0.6 | 0.4 | 0.010 | | 0.005 | | | Bal |
| 25 | 0.0025 | 1.6 | 0.6 | 0.4 | 0.010 | — | | 0.001 | | Bal |
| 26 | 0.0024 | 1.6 | 0.6 | 0.4 | 0.010 | — | | 0.003 | | Bal |
| 27 | 0.0021 | 1.6 | 0.6 | 0.4 | 0.010 | — | | | 0.001 | Bal |
| 28 | 0.0027 | 1.6 | 0.6 | 0.4 | 0.010 | — | | | 0.003 | Bal |

TABLE 10

| Steels | Phase in reheating | m | Ar1 | W15/50 (W/kg) | B50(T) | Remark |
|---|---|---|---|---|---|---|
| 21 | gamma + alpha | 0.2 | 1030 | 3.03 | 1.742 | Inventive |
| 22 | gamma + alpha | 0.2 | 1030 | 3.38 | 1.731 | Comparative |
| 23 | gamma + alpha | 0.2 | 1030 | 3.07 | 1.739 | Inventive |
| 24 | gamma + alpha | 0.2 | 1030 | 3.35 | 1.733 | Comparative |
| 25 | gamma + alpha | 0.2 | 1030 | 3.10 | 1.741 | Inventive |
| 26 | gamma + alpha | 0.2 | 1030 | 3.41 | 1.723 | Comparative |
| 27 | gamma + alpha | 0.2 | 1030 | 3.05 | 1.745 | Inventive |
| 28 | gamma + alpha | 0.2 | 1030 | 3.36 | 1.726 | Comparative |

$W_{15/50}$: loss occurring when magnetized with 1.5 Tesla at 50 Hz.

$B_{50}$: magnetic flux density occurring when a magnetic field of 5000 A/m at 50 Hz was applied.

As can be seen in Table 10, steels 21, 23, 25 and 27 containing S, N, Nb and Ti in amounts within the inventive range were excellent in iron loss and magnetic flux density compared to the comparative steels 22, 24, 26, and 28.

Example 6

Steels shown in Table 11 below were examined for magnetic properties in the conditions of Example 3 while changing temperature elevation rate, and the results are shown in Table 12.

TABLE 11

| Steels | C | Si | Mn | Al | P | S | N | Ti | Fe |
|---|---|---|---|---|---|---|---|---|---|
| A | 0.0026 | 1.6 | 0.6 | 0.4 | 0.010 | 0.002 | 0.001 | 0.001 | Bal |
| B | 0.0024 | 1.7 | 0.8 | 0.4 | 0.010 | 0.002 | 0.002 | 0.001 | Bal |

TABLE 12

| No. | Steels | Temperature elevation rate | W15/50 | B50(T) | Shape | Remark |
|---|---|---|---|---|---|---|
| 1 | A | 5 | 3.31 | 1.721 | good | Comparative |
| 2 | A | 15 | 3.13 | 1.735 | good | Inventive |
| 3 | A | 30 | 3.07 | 1.745 | good | Inventive |
| 4 | A | 50 | 3.09 | 1.737 | bad | Comparative |
| 5 | B | 5 | 3.22 | 1.714 | good | Comparative |
| 6 | B | 15 | 2.82 | 1.731 | good | Inventive |
| 7 | B | 30 | 2.80 | 1.735 | good | Inventive |
| 8 | B | 50 | 3.05 | 1.726 | bad | Comparative |

As can be seen in Table 12 above, steels 2, 3, 6 and 7 having compositions according to the present invention are excellent in magnetic properties and sheet shapes.

The invention claimed is:

1. A method for manufacturing a non-oriented electrical steel sheet that has excellent magnetic properties while hot-rolled sheet annealing can be omitted, the method comprising the steps of:

reheating a slab comprising 0.005 wt % or less of C, 1.0-3.0 wt % of Si, 0.1-2.0 wt % of Mn, 0.1 wt % or less of P, 0.1-1.5 wt % of Al, wherein the elements Mn and Al satisfy an equation of $-0.2<Mn-Al<1.0$ and a remainder of Fe and other inevitable impurities, to a temperature ranging from Ar1 to 1250° C.;

hot-rolling the reheated slab in such a manner that 70% or more of a total hot finish rolling is performed in a two-phase region of austenite+ferrite, and the remaining reduction ratio is performed in a ferrite single-phase region, in which the reduction ratio in a final pass becomes {20−(960−finish rolling end temperature)/20}% or less;

winding the hot-rolled steel sheet at a temperature of 650-800° C.;

cold-rolling the wound steel sheet to a predetermined thickness; and subjecting the cold-rolled steel sheet to final annealing.

2. The method of claim 1, wherein the slab additionally contains 0.007-0.15 wt % of at least one element selected from Sb and Sn.

3. The method of claim 1, wherein the impurities contained in the steel sheet are comprised of 0.003 wt % or less of S, 0.003 wt % or less of N, 0.002 wt % or less of Nb, and 0.002 wt % or less of Ti.

4. The method of claim 1, wherein the final annealing step is carried out at a temperature elevation rate of 10~40° C./sec.

5. The method of claim 1, wherein the Ar1 temperature of the slab is 960-1060° C.

6. The method of claim 1, wherein the start temperature of the hot finish rolling is Ar1+50° C. or more, and the end temperature of the hot finish rolling is Ar1−80° C. or more.

* * * * *